United States Patent [19]

Summa

[11] Patent Number: 4,981,081

[45] Date of Patent: Jan. 1, 1991

[54] CENTER LINK PUSHER DOG FOR POWER AND FREE CONVEYORS

[75] Inventor: Gareth D. Summa, Riverside, Mo.

[73] Assignee: Mid-West Conveyor Company, Inc., Kansas City, Kans.

[21] Appl. No.: 356,363

[22] Filed: May 24, 1989

[51] Int. Cl.[5] ..... B61B 10/00

[52] U.S. Cl. ..... 104/172.5

[58] Field of Search ..... 104/172.2, 172.3, 172.5, 104/172.4, 172.1; 198/687, 731, 733

[56] References Cited

U.S. PATENT DOCUMENTS

| | | | |
|---|---|---|---|
| 1,518,431 | 12/1924 | Hurst | 104/172.2 |
| 2,965,043 | 12/1960 | Klamp et al. | 104/88 |
| 3,377,962 | 4/1968 | Dehne | 104/172.4 |
| 3,472,177 | 10/1969 | Di Rosa | 104/172.4 |
| 3,523,504 | 8/1970 | Jones | 104/172.4 |
| 3,623,538 | 11/1971 | Wakabayashi | 104/172.4 |
| 3,664,267 | 5/1972 | Di Rosa | 104/172.4 |
| 3,774,545 | 11/1973 | Karlstrom | 198/687 |
| 3,814,024 | 6/1974 | Peter | 104/172.4 |
| 3,817,187 | 6/1974 | Thompson | 104/172.2 |
| 3,830,165 | 8/1974 | Turner | 104/172.5 |
| 3,860,457 | 1/1975 | Vourinen et al. | 148/15 |
| 4,262,796 | 4/1981 | McDonald | 198/687 |
| 4,318,660 | 3/1982 | Checkley et al. | 414/518 |
| 4,483,252 | 11/1984 | Pierson | 104/172.3 |
| 4,646,650 | 3/1987 | Kondo et al. | 104/172.3 |
| 4,790,247 | 12/1988 | Summa | 104/172.2 |

*Primary Examiner*—Robert P. Olszewski
*Assistant Examiner*—Mark T. Le
*Attorney, Agent, or Firm*—Litman, McMahon & Brown

[57] ABSTRACT

A center link pusher dog assembly for power and free conveyors includes a pusher dog member with a mounting base and a pusher dog projection upstanding therefrom. The mounting base has depending lugs and a rear shoulder to engage an abutment formed by a reduced central area of a center link of a conveyor chain. A bore through the pusher dog member recevies a bolt for clamping a center link between the pusher dog member and a conventional chain support type of power trolley. The lugs engage upstanding teeth on a mounting end of the power trolley and side walls of the center link to fix the longitudinal position of the pusher dog member relative to the power trolley and the center link and to fix its lateral position relative to the center link.

17 Claims, 1 Drawing Sheet

Fig.1.
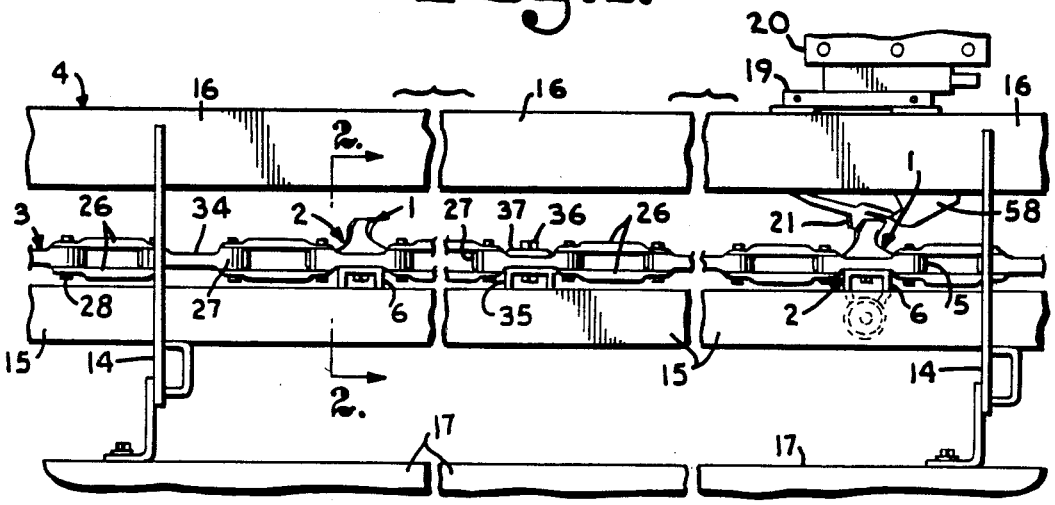
Fig.2.
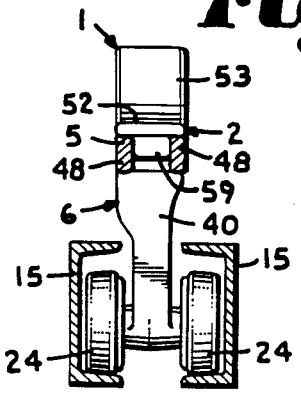
Fig.5.
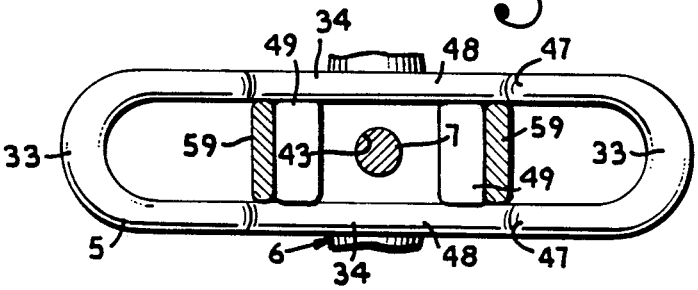
Fig.4.
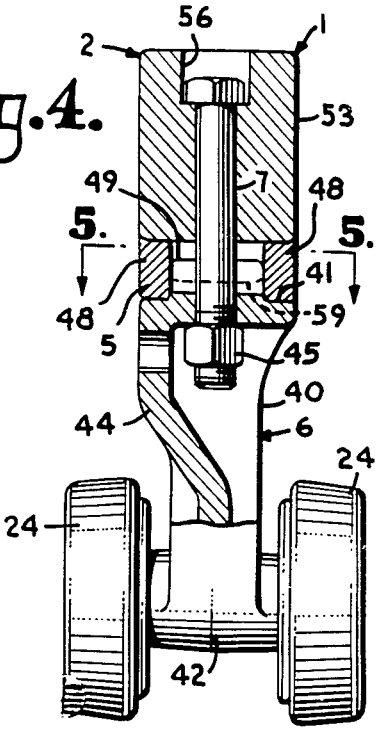
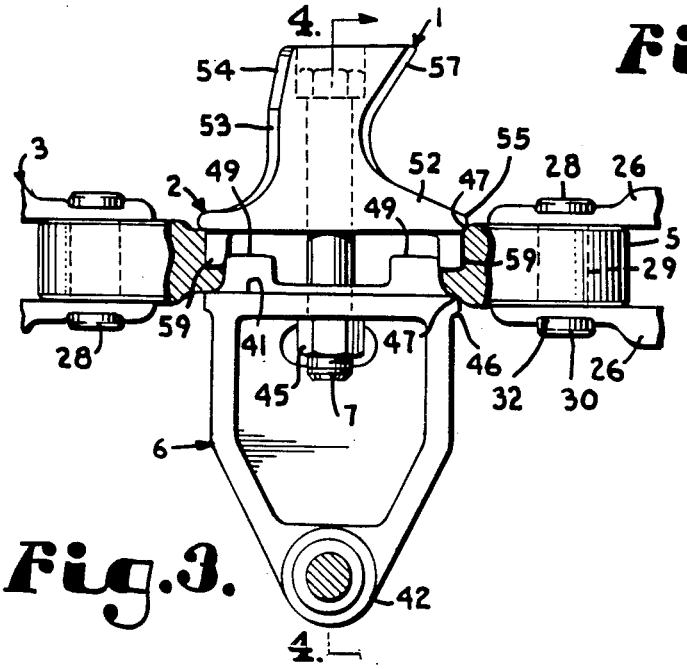
Fig.3.

CENTER LINK PUSHER DOG FOR POWER AND FREE CONVEYORS

FIELD OF THE INVENTION

The present invention relates to inverted power and free conveyors and, more particularly, to a center link mounted pusher dog member for such a conveyor which is removably connected to a center link of the conveyor chain.

BACKGROUND OF THE INVENTION

In typical power and free conveyors, a load carrier is mounted on a load trolley or trolleys which run on a load track. The load carrier is moved by a continuously running power or drive chain by engagement between a drive or pusher dog on the drive chain and a retractable trolley dog on the load carrier or trolley. The drive chain is supported by power trolleys running along a power track. In overhead power and free conveyors, a load supported by the load carrier is suspended below the tracks supporting the load trolleys and the drive chain. The pusher dog extends downward to engage an upwardly extending trolley dog. The trolley dog may be retracted from the pusher dog to allow the load to coast on a downhill section of the load track, to halt the load for operations thereon, or the like. On many power and free conveyors, the load trolleys incorporate accumulation mechanisms which cause drive disengagement of carriers approaching behind a halted carrier to prevent collisions between the carriers and loads.

Inverted power and free conveyors are similar to overhead power and free conveyors except that, as their name suggests, they are turned upside down. On inverted power and free conveyors, a power track supporting the power trolleys carrying the drive chain is at the lowest level. Above the power track is the load track supporting the load trolleys, with the load carrier above the load track. The pusher dogs of inverted power and free conveyors extend upward to engage downwardly extending trolley dogs which may be retracted to disengage drive from the load for the same reasons as for overhead track conveyors. Both overhead and inverted power and free conveyors find application in factories, such as on automotive assembly lines to carry automotive bodies as manufacturing operations are performed.

Drive chains for both types of power and free conveyors are similar and many types are formed by alternating center links and pairs of side links. In a typical drive chain, each center link is a vertically open endless loop with straight sides and cylindrical or semi-annular ends. The side links are elongated members or bars which are horizontally flattened. The opposite ends of an upper and a lower side link of each pair overlap the adjacent center links and are connected to the center links by cylindrical chain pins. The chain pins have T-shaped heads at opposite ends which engage recesses on the outer surfaces of the side links. The sides of the center links are "waisted" or dumbbell shaped and the side links have longitudinal slots in their ends to allow the drive chain can be assembled without tools. The center links pivot about the chain pins or the side links with chain pins pivot about the center links for the drive chain to pass about a curve having a vertical axis.

The drive chain is supported by the power track on power trolleys which are usually attached to center links at selected spacings. On overhead conveyors the power trolleys extend above the drive chain while on inverted conveyors, the power trolleys extend below the drive chain. The drive chain is usually driven by a large diameter drive wheel having gear teeth or sprockets which mesh between the side links to engage a trailing end of a center link.

Pusher dogs for such chains are usually in the form of side link pusher dogs which replace one of the side links of a pair. A side link pusher dog for an overhead conveyor has an integral dog or projection extending downwardly from a side link bar to engage an upwardly extending trolley dog. Conversely, a side link pusher dog for an inverted conveyor extends upward. Typically, side link pusher dogs have an integral chain pin extending from the side link bar on the opposite side from the dog projection. Thus, a side link pusher dog connects with a leading center link by the integral chain pin and with a trailing center link by a conventional chain pin. A conventional side link is then connected with the opposite ends of the integral chain pin and the conventional chain pin to complete the modified section of the chain.

In order to reduce frictional wear of the components of the drive chain and to prevent binding therebetween which might result in breakage, the frictionally engaging surfaces must be lubricated. This is usually accomplished by an automatic chain pin oiler machine which might also be adapted to lubricate power trolley wheel bearings. The oiler machine detects the presence of a center link and directs a shot of lubricant toward the bearing surfaces of the ends of the center link and the chain pins. The shot of lubricant is usually directed toward the slots in the upper side links on each side of the center link, and gravity and flexure of the pivotal joint disperse the lubricant over the bearing surfaces.

On a drive chain for an overhead power and free conveyor drive chain, a side link pusher dog is located on the lower side of a side link pair with a conventional slotted side link on the upper side of the pair. Thus, a conventional oiler machine can be used to lubricate such a chain since the pivot joints are accessible to the oiler nozzles through the slots on the upper side link. However, a problem arises in lubricating drive chains for inverted power and free conveyors, because the side link pusher dog is located on the upper side of a side link pair. While the trailing end of the side link pusher dog is slotted, the dog projection occupies the position at the leading end of the side link bar where a chain pin slot of an ordinary side link would be. Thus, there is no access for lubricating the leading pivot joint of a side link pusher dog for an inverted power and free conveyor drive chain using a conventionally configured chain pin oiler machine.

When pusher dogs of power and free conveyors engage the trolley dogs of stationary carriers supporting heavy loads, they have a tendency to react in a vertical direction away from the trolley dogs. Thus, in an inverted conveyor, the pusher dog tends to react downward. In order to avoid possible slippage of the pusher dog past the trolley dog during such reactions, the pusher dog is supported by power trolleys positioned close to the pusher dog. On a conveyor chain with side link pusher dogs, a power trolley, identical to the chain support trolleys, is usually attached to the center links immediately in front of and behind a side link pusher dog assembly. While it would be possible to provide a single power trolley on the conventional side link member of such an assembly, such a trolley would have to be specially designed since the chain support trolleys have a height designed for their attachment to the center links and would misposition a conventional side link pusher dog assembly. Thus, two trolleys per dog are required by the design of side link pusher dogs whereas only one per dog is functionally required. With a pusher dog every few feet, this can amount to a considerable expense on a long conveyor chain, which may run to several thousand feet in a large installation.

When it is necessary to replace a side link pusher dog because of wear or damage, the conveyor chain must be loosened and disassembled to free the old member. For this, it is necessary to move the side link type members toward the centers of the adjacent center links, which are occupied by the power trolleys. Thus, the leading and trailing power trolleys adjacent the pusher dog to be replaced must be removed to disassemble the chain.

SUMMARY OF THE INVENTION

The present invention provides an improved pusher dog for power and free conveyors which overcomes some of the problems associated with conventional side link pusher dogs. The improved pusher dog is a center link mounted pusher dog which is mounted on a center link of the conveyor chain by connection therethrough to a single power trolley. The center link pusher dog member includes a mounting base with lugs extending therefrom which mesh with teeth on the mounting end of the power trolley body. The base of the pusher dog and the end of the trolley body have shoulders which engage abutments formed by the reduced central portions of the side walls of the center link. The pusher dog teeth also engage the side walls of the center link. By these means, the longitudinal position of the pusher dog relative to the trolley body is fixed; the longitudinal positions of the pusher dog and trolley body relative to the center link are fixed; and the lateral position of the pusher dog relative to the center link is fixed.

The power trolley which supports the center link pusher dog is identical to the type which is connected to center links at selected intervals to support the conveyor chain above the power track of the conveyor. Only one such power trolley is required for each center link pusher dog according to the present invention, resulting in considerable savings on conveyor chain components and the labor required to assemble the chain. Additional time and labor savings are realized when pusher dog replacement is required since it is not necessary to disassemble the conveyor chain for this purpose. It is only necessary to remove the old member and replace it with a new pusher dog. A power and free conveyor chain employing the center link pusher dog of the present invention is more uniform, since it is formed entirely of conventional center links and side link assemblies. Finally, on an inverted power and free conveyor, lubrication of chain components is not interferred with by the center link pusher dog, in contrast to the use of conventional side link pusher dogs.

In a preferred embodiment of the present invention, the center link pusher dog member is formed by casting ductile iron which is heat treated by an austempering process. This results in the necessary toughness to withstand shock and shear loads to which the pusher dog is subjected when engaging heavy stationary loads. Additionally, manufacture of the center link pusher dog member by casting and heat treating is more economical than by forging and machining.

OBJECTS OF THE INVENTION

The principal objects of the present invention are: to provide an improved pusher dog member for a chain of a power and free conveyor, particularly an inverted type of such conveyor, which is composed principally of alternating center links and sets of side link members pivotally connected between the center links; to provide such a member which overcomes some of the limitations of conventional side link pusher dog members; to provide such a member which facilitates the installation and replacement of pusher dogs on such a conveyor chain by reducing the number of chain components required for a given length and by eliminating the need to disassemble the chain for pusher dog replacement; to provide such a member which results in a more uniform chain than one using side link pusher dog components; to provide such a member including a pusher dog projection with a mounting base which is mounted on a center link of such a conveyor chain; to provide such a member which only requires a single power trolley to support the pusher dog, the trolley being identical to the type used to support such a chain relative to a power track; to provide such a member including lugs extending from the mounting base which engage cooperating teeth on the power trolley used therewith to fix the longitudinal position of the pusher dog relative to the power trolley and which engage side walls of the center link to which it is connected to fix the lateral position of the pusher dog relative to the center link; to provide such a member including shoulders which engage abutments formed on the side walls of the center link by reduced central areas of the side walls to fix the longitudinal position of the pusher dog relative to the center link; to provide such a member which does not interfere with lubrication of the chain bearing surfaces by a conventional chain pin oiler machine; to provide such a member which is preferably formed of cast, austempered ductile iron; and to provide such a member which is retrofittable to many types of existing power and free conveyor chains; to provide such a member which is well adapted for either overhead or inverted types of power and free conveyor chains; and to provide such a center link pusher dog member which is economical to manufacture, convenient to install, durable in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a fragmentary side elevational view of an inverted power and free conveyor incorporating a center link pusher dog assembly embodying the present invention.

FIG. 2 is a somewhat enlarged transverse sectional view taken along line 2—2 of FIG. 1 and illustrates further details of the center link pusher dog assembly.

FIG. 3 is a greatly enlarged fragmentary side elevational view of the center link pusher dog assembly with a portion broken away to illustrate cooperation between a center link pusher dog member and a power trolley of the assembly.

FIG. 4 is fragmentary transverse sectional of the center link pusher dog assembly taken along line 4-4 of FIG. 3 and illustrates internal details of the pusher dog member and the power trolley.

FIG. 5 is a fragmentary top longitudinal sectional view of the center link pusher dog assembly taken on line 5-5 of FIG. 4 and illustrates details of cooperation between the pusher dog member and the power trolley and a center link to which they are attached.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a center link pusher dog member embodying the present invention. The member 1 forms part of a center link pusher dog assembly 2 of a power or drive chain 3 of an inverted power and free conveyor system 4. The assembly 2 generally includes the pusher dog member 1, a center link 5 of the chain 3, and a power trolley 6. The member 1 and trolley 6 are connected by a fastener 7 to clamp the center link 5 therebetween. The center link pusher dog member 1 according to the present invention facilitates initial assembly of the chain 3 and replacement of the member 1 when necessary, reduces the number of components per unit length of the chain 3, and results in greater uniformity of the chain 3.

The illustrated conveyor 4 system is a conventional inverted power and free conveyor and includes standards 14 supporting a power or drive track 15 and a load track 16 above a support surface 17 which may be a floor of the plant in which the conveyor system 4 is installed. The load track 16 is formed by a pair of inwardly turned channels which support a load trolley 19. The load trolley 19 is adapted for attachment of a load carrier 20 thereto to support a load to be conveyed by the conveyor system 4, such as an automobile chassis in an automotive assembly plant. For conveying relatively long loads, a load carrier 20 may be supported by a pair of load trolleys 19. The load trolley 19 includes a depending load trolley dog 21 which may be retracted to prevent movement of the load trolley by the conveyor chain 3, as at a station where manufacturing operations are to be performed, or extended for engagement by the chain 3 to move the load to the next station.

The power track 15 is similar to the load track 16 and is illustrated as a pair of mutually inwardly turned channels supporting wheels 24 of the power trolley 6. The conveyor chain 3 is formed by alternating sets of side links 26 and the center links 27 pivotally connected by chain pins 28. Each chain pin includes a cylindrical shaft 29 (FIG. 3) with T-shaped heads 30 at opposite ends. The side links 26 are elongated, flattened bars with longitudinal slots (not shown) at opposite ends to receive the chain pins 28 and transverse recesses 32 intersecting the slots to position the heads 30. The center links 27 are one piece members formed by vertically open elongated loops with annular ends 33 frictionally engaging the shafts 29 of the chain pins 28. The illustrated center links 27 are somewhat dumbbell shaped as viewed from the side with reduced center portions 34 of the sides. The chain 3 is supported with respect to the power track 15 by chain support trolleys 35 attached to selected center links 27 at intervals along the chain 3. Fasteners 36, such as bolts and nuts, clamp each selected center link 27 between a trolley 35 and a cap member 37.

The chain 3 is assembled, without tools, by placing upper and lower side links 26 in the center portion 34 of a center link 27, inserting chain pins 28 through the slots in the side links, rotating the heads 30 of the pins to align with the recesses 32 of the side links, and finally sliding the side links to the end 33 of a center link. The load trolley 19 is conveyed by engagement of a dog on the moving conveyor chain 3 with the load trolley dog 21. The chain 3 is propelled by sprockets or teeth of a drive gear (not shown) which engage ends 33 of the center links 27 in the space between a pair of side links 26.

The pusher dog supporting power trolleys 6 are virtually identical to the chain supporting trolleys 35. Each trolley 6 includes a trolley body 40 having an upper mounting end 41 and having the trolley wheels 24 journaled thereto at a lower end 42. The mounting end 41 includes a bore 43 to receive the fastener 7, such as a threaded bolt. A web 44 of the trolley body 40 is centered toward the lower end 42 and is offset laterally at the mounting end 41 to accommodate a nut 45 on the bolt 7. The mounting end 41 is provided with a rear end shoulder 46 (FIG. 3) to cooperate with abutments 47 formed by the reduced areas 34 of the side walls 48 of the center link 5 to limit the longitudinal movement of the trolley 6 relative to the center link 5. An upper surface of the mounting end 41 is provided with upstanding teeth 49 for a purpose which will be detailed below.

The center link pusher dog member 1 includes a lower mounting base 52 with a dog projection 53 upstanding therefrom. The projection 53 has a front contact surface 54 which engages a similar contact surface on the load trolley dog 21 to convey the load trolley 19. The mounting base 52 includes a rear shoulder 55 to engage one of the center link abutments 47 to limit longitudinal movement of the member 1 relative to the center link 5. The pusher dog member 1 is provided with a countersunk bore 56 to receive the bolt 7, which may have an Allen hex head to facilitate tightening the bolt 7 and nut 45 to form the pusher dog assembly 2. A rear contact surface 57 is provided on the dog projection 53 for engagement with a holdback dog 58 of the load trolley 19 to prevent runaway of the load trolley 19 and load carrier 20, as on a downhill section of the conveyor 4.

The mounting base 52 has depending lugs 59 which cooperate with the upstanding teeth 49 of the trolley body 40. The lugs 59 of the pusher dog member 1 are spaced to fit snugly outside the teeth 49 of the trolley body 40. The engagement between the lugs 59 and teeth 49 fixes the mutual longitudinal positions of the dog member 1 and trolley 6. The lugs 59 have a width to engage the side walls 48 of the center link 5 to fix the lateral position of the pusher dog member 1 relative to the center link 5. With the center link 5 clamped between the member 1 and the trolley 6 by tightening the nut 45 on the bolt 7, tendencies of the pusher dog member 1 to be slid rearward in reaction to abrupt engagement of the front contact surface 54 of the dog projection 53 with the load trolley dog 21 is resisted by engagement of the shoulder 55 with the upper abutment 47 of the center link 5 and is aided in such resistance by engagement of the shoulder 46 of the trolley body 40 with the lower abutment 47 of the center link through the engagement of the lugs 59 of the member 1 with the teeth 49 of the trolley body 40. Lateral reactions of the member 1 are resisted engagement of the lugs 59 with the side walls 48 of the center link 5. As is illustrated in FIG. 5, the teeth 49 of the trolley body 40 also engage the side walls 48 of the center link 5.

The center link pusher dog member 1 may be manufactured by any appropriate process or processes, such as forging and machining. In a preferred embodiment of the present invention, the member 1 is formed of cast ductile iron which is austempered. Austempering of ductile iron is well known in the metal forming arts and exemplary details regarding this process may be obtained by reference to U.S. Pat. No. 3,860,457 which issued to Vourinen et al. on Jan. 14, 1975 and which is incorporated herein by reference. The center link pusher dog member 1 which is formed by these processes has the necessary the toughness to withstand shock loads when the dog projection 53 engages a stationary load and the surface hardness to reduce surface wear, particularly of the front contact surface 54.

The configuration of a power and free conveyor chain 3 employing the center link pusher dog member 1 has many advantages over chains using conventional side link pusher dogs. Initial assembly of the chain 3 is facilitated in that the member 1 is simply substituted for the cap 37 at selected intervals along the chain 3. Replacement of the pusher dog members 1, when necessary because of wear or the like, is facilitated because it is unnecessary to break the chain 3 for such replacement as it is with chains using side link pusher dogs. Only one power trolley 6, identical to the chain support trolleys 35, is required per center link pusher dog member 1, in contrast to chains with side link pusher dogs which require two power trolleys per dog. A chain 3 employing the pusher dog member 1 is somewhat more uniform than chains employing side link pusher dogs since with the members 1 conventional side links 26, center links 27 and 7, and connection pins 28 are used. On inverted power and free conveyors, the center link pusher dog member 1 does not interfere with the lubrication of the chain components by a conventional chain pin oiler machine (not shown) as do conventional side link pusher dog members.

It is to be understood that while certain forms of the present invention have been illustrated and described herein, it is not to be limited to the specific forms or arrangement of parts described and shown.

What is claimed and desired to be secured by Letters Patent is as follows:

1. A pusher dog assembly for use with a drive chain of a power and free conveyor formed of alternating elongated one piece center links and pairs of side links, said assembly comprising:

(a) power trolley means supported by a power track of said power and free conveyor;

(b) a pusher dog;

(c) fastener means removably connecting said dog to said trolley means and clamping a center link between said dog and said trolley means and (d) cooperating engagement means formed on said dog and said trolley means and directly engaging said dog with said trolley means in a direction of travel of said chain to prevent relative movement between said dog and said trolley means in said longitudinal direction.

2. An assembly as set forth in claim 1 wherein:

(a) said center link has an elongated center opening; and (b) said fastener means extends between said dog and said trolley means through said opening.

3. An assembly as set forth in claim 1 and including:

(a) shoulder means on said dog and on said trolley means engaging abutment means on said center link to maintain a longitudinal position of said dog and said trolley means relative to said center link.

4. An assembly as set forth in claim 1 wherein:

(a) said center link includes opposite side walls;

(b) said dog includes lug means extending from a mounting end thereof; and (c) said lug means engages said side walls of said center link within a center opening therebetween to maintain a lateral position of said dog relative to said center link.

5. An assembly as set forth in claim 1 wherein said power trolley means includes:

(a) a trolley body having a mounting end engaging said center link; and (b) a pair of trolley wheels journaled at an end of said body opposite said mounting end, said wheels for engagement with said power track.

6. An assembly as set forth in claim 1 wherein:

(a) said trolley means includes a single trolley including a trolley body and a pair of trolley wheels journaled thereon.

7. An assembly as set forth in claim 1 wherein said fastener means includes:

(a) a threaded bolt engaged between said dog and said trolley means.

8. An assembly as set forth in claim 1 wherein:

(a) said conveyor is an inverted power and free conveyor;

(b) said dog is positioned on an upper side of said center link; and (c) said trolley means is positioned on a lower side of said center link.

9. An assembly as set forth in claim 1 wherein:

(a) said pusher dog is formed of cast austempered ductile iron.

10. A pusher dog assembly for use with a drive chain of an inverted power and free conveyor formed of alternating center links and pairs of side links and comprising:

(a) an elongated one piece center link having side walls forming an elongated center opening;

(b) a single power trolley including a trolley body having a mounting end and a pair of trolley wheels journaled at a body end opposite said mounting end;

(c) a tooth upstanding from said mounting end of said trolley body;

(d) an upwardly extending pusher dog having a mounting base;

(e) a lug extending downward from said mounting base of said dog; and (f) fastener means removably connecting said dog to said trolley through said opening of said center link, said mounting end of said trolley body and said mounting base of said dog clamping a central portion of said center link therebetween and said lug of said dog engaging said tooth of said trolley body to positively position said dog relative to said trolley body.

11. An assembly as set forth in claim 10 wherein:

(a) central portions of said center link side walls have reduced height forming longitudinally spaced abutments on upper and lower sides thereof;

(b) said mounting end of said trolley body and said mounting base of said dog have respective shoulder means thereon; and (c) said shoulder means engage at least one of said abutments to maintain a longitudinal position of said dog and said trolley body relative to said center link.

12. An assembly as set forth in claim 10 wherein:

(a) said lug engages said side walls of said center link within said center opening to maintain a lateral position of said dog relative to said center link.

13. An assembly as set forth in claim 10 wherein:

(a) said trolley body includes a pair of said teeth upstanding from said mounting end thereof;

(b) said dog includes a pair of said lugs extending downward from said mounting base thereof; and (c) one pair of said teeth and said lugs is received within and engages the other of said pairs to positively position said dog relative to said trolley body.

14. An assembly as set forth in claim 10 wherein said fastener means includes:

(a) a threaded bolt engaged between said dog and said trolley body.

15. An assembly as set forth in claim 10 wherein:

(a) said pusher dog is formed of cast austempered ductile iron.

16. A pusher dog assembly for use with a drive chain of an inverted power and free conveyor formed of alternating center links and pairs of side links and comprising:

(a) an elongated one piece center link having side walls forming an elongated center opening, central portions of said center link side walls having reduced height forming longitudinally spaced abutments on upper and lower sides thereof;

(b) a single power trolley including a trolley body having a mounting end and a pair of trolley wheels journaled at a body end opposite said mounting end, said mounting end including a trolley shoulder;

(c) a pair of longitudinally spaced teeth upstanding from said mounting end of said trolley body;

(d) an upwardly extending pusher dog having a mounting base, said mounting base including a dog shoulder;

(e) a pair of longitudinally spaced lugs extending downward from said mounting base of said dog; and (f) a threaded bolt and nut removably connecting said dog to said trolley through said opening of said center link, said mounting end of said trolley body and said mounting base of said dog clamping said central portion of said center link therebetween, said lugs engaging said teeth to positively position said dog relative to said trolley body, said teeth engaging said side walls of said center line to laterally position said dog relative to said center link, and said dog shoulder and said trolley shoulder engaging respective abutments of said center link to longitudinally position said dog and said trolley relative to said center link.

17. An assembly as set forth in claim 16 wherein:

(a) said pusher dog is formed of cast austempered ductile iron.

* * * * *